US006909238B2

(12) United States Patent
Huang

(10) Patent No.: US 6,909,238 B2
(45) Date of Patent: Jun. 21, 2005

(54) BACK-LIGHTED CONTROL AND PROTECTION DEVICE FOR MULTI-LAMP LCD

(76) Inventor: Shih-Chung Huang, 12Fl., No. 8, Lane 202, Jhongsing St., Jhonghe City, Taipei County (TW)

( * ) Notice: Subject to any disclaimer, the term of this patent is extended or adjusted under 35 U.S.C. 154(b) by 0 days.

(21) Appl. No.: 10/624,522

(22) Filed: Jul. 23, 2003

(65) Prior Publication Data

US 2005/0017647 A1 Jan. 27, 2005

(51) Int. Cl.[7] ..... H05B 37/00
(52) U.S. Cl. ..... 315/119; 315/291; 315/307; 362/216
(58) Field of Search ..... 315/119, 157, 315/158, 169.3, 291, 307, DIG. 4; 362/216

(56) References Cited

U.S. PATENT DOCUMENTS 6,157,143 A * 12/2000 Bigio et al. ..... 315/307
6,166,491 A * 12/2000 Tsuchiya et al. ..... 315/169.3
6,650,822 B1 * 11/2003 Zhou ..... 385/147
6,707,264 B2 * 3/2004 Lin et al. ..... 315/307

* cited by examiner

*Primary Examiner*—Tuyet Vo
*Assistant Examiner*—Jimmy Vu
(74) *Attorney, Agent, or Firm*—Raymond Y. Chan; David and Raymond

(57) ABSTRACT

This back-lighted control and protection device for multi-lamp liquid crystal display consists of a LCD back-lighted driver circuit, a lamp driven by the driver circuit that generates high-voltage power supply and lights up the LCD backplate, a sensor unit that is used to detect the light source of the lamp and a protection circuit that is connected to the output of the sensor unit and accepts the sensor signals given by the sensor unit to stop the driver circuit from output of high-voltage power supply.

16 Claims, 7 Drawing Sheets

BACK-LIGHTED CONTROL AND PROTECTION DEVICE FOR MULTI-LAMP LCD

FIELD OF THE INVENTION

The present invention relates generally to a back-lighted control and protection device for multi-lamp LCD, especially for lamp detection through sensing the light source. When the lamp is abnormal or has an open circuit, the driver circuit can be stopped from output of high-voltage power supply immediately.

BACKGROUND OF THE INVENTION

As the size of LCD keeps on increasing and design of the control circuit becomes complicated relatively, requirements and functions of back-lighted power supply are getting demanding. Due to an extreme increase on the number of back-lighted lamps resulted from large-sized LCDs, plenty of current problems of multiple lamps are derived, the issue of open circuit resulted from a malfunctioned lamp and protection method in particular.

The control circuit of a fluorescent lamp used for LCD back-lighted earlier had a small quantity with simple functions; therefore, design of the protection circuit was not emphasized, which was only in compliance with designated specifications. However, along with tremendous demands from the consumer market, requirements for functions and specifications have been increasing and improving. Thus, protection design tends to become more strict and complicated. At present, as LCD becomes large-sized and is used for television design at home, protection requirements are even more strict than before, which also increases complex on circuit design.

Generally speaking, the backlit driven protection circuit occupies most of the elements on the LCD and high quality of large-scale mass production is not easy. Besides, the major purpose of protection is to solve the high-voltage issue caused by an open circuit as well as to simulate a short circuit when the human body gets an electric shock. Consequently, protection function is typically designed to solve the abnormal problems caused by voltage and current of the lamp.

A general back-lighted driver circuit protection device for LCD is shown as FIG. 1, which includes circuits 16 and 17 of detecting current of the lamp and circuits 18 and 19 of detecting voltage of the lamp. The step-down loop of the voltage detection device 20 has two voltage divided impedances to reduce the high output of driven voltage from the transformer to standard signals that can be detected by general low voltage elements. This method can determine if the current potential is normally operated or if open circuit or short circuit of the lamp happens through the voltage detected. The current detection device 21 consists of current induced elements series connected to the path on which current of the LCD back-lighted lamp passes and is used to detect the status quo of the current of the lamp. Thus, condition of lamp current can be controlled through the current detection device.

An open circuit or any abnormality of the lamp can be decided via the voltage detection circuits 18 and 19 and the voltage detection device 20 or via the current detection circuits 16 and 17 and the circuit loop of the current detection device 21. Consequently, the protection circuit device 22 may be activated to protect the driver circuit of the backlit lamp 23 and prevent the transformer 24 from output of voltage.

Please refer to FIGS. 1 and 2. An example of the protection device for single lamp is given in FIG. 1 and that for dual lamps is given in FIG. 2. For the circuit design and a well protected system commonly used at present, a lot of voltage detection elements, current detection elements and circuit protection elements are required to ensure a safer operation of the high voltage from the transformer and the back-lighted lamp used. For the operation of parallel connected multiple lamps in particular, the number of elements consumed is doubled.

SUMMARY OF THE INVENTION

As the number of lamps increased and required elements double, the main purpose of this invention is to reduce the number of required elements and improve the protection device with the same features so as to cope with the demand for large-sized LCD and simplify the light source system design that is getting complicated for large-scale LCD system in the future.

To achieve the aforementioned objective, the invention of the back-lighted control and protection device for multi-lamp LCD comprises a driver circuit, at least one lamp that is connected to and driven by the driver circuit, at least one sensor unit that receives the light source generated by the aforementioned lamp and a protection unit that receives the signals given by the sensor unit. When the light source is detected, the driver circuit will be cut off and the output of high voltage will be stopped so as to ensure the operation life of the driver circuit.

DETAILED DESCRIPTION OF THE EMBODIMENT

Figure 3:
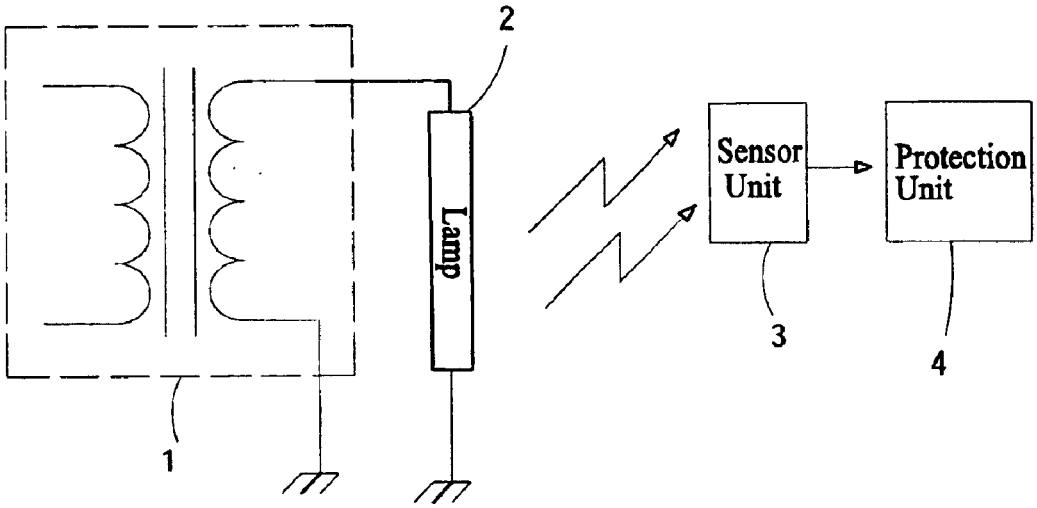
FIG. 3 shows a view of single lamp for this invention.

A detailed description and summary of the invention is made with drawings as follows:

Refer to FIG. 3 for the drawing of this invention for single lamp. As the figure shows, the back-lighted control and protection device for multi-lamp LCD consists of a LCD backlit lamp driver circuit (hereinafter called "a driver circuit") 1, more than a lamp 2 that is connected to and driven by the driver circuit 1, at least a sensor unit 3 that receives the light source generated by the lamp 2 and a protection unit 4 that receives the signals from the sensor unit 3. When the light source is detected, the driver circuit 1 will be cut off and the output of high voltage will be stopped so as to ensure the operation life of the driver circuit 1.

As the driver circuit 1 is a traditional technique, unnecessary details won't be given here. The driver circuit 1 is an output of high-voltage power supply.

The lamp 2 connected to the output of the driver circuit 1 is driven by the high-voltage power supply from the driver circuit 1.

The sensor unit 3 is used to detect the light generated by the lamp 2.

The protection unit 4 is connected to the output of the sensor unit 3 and used to receive the signals given by the sensor unit 3.

When the driver circuit 1 is actuated, high-voltage power supply is generated to drive the lamp 2, which results to the output of a light source. As the sensor unit 3 detects the light source from the lamp 2, no signals will be given by the sensor unit 3. However, when the sensor unit 3 does not detect the light source from the lamp 2, a signal will be given by the sensor unit 3 at once. After the protection unit 4 receives the signal, it is known that the lamp 2 is malfunctioned or has an open circuit. The protection unit 4 will give out a signal immediately to prevent the driver circuit 1 from output of high-voltage power to protect the driver circuit 1.

Figure 1:
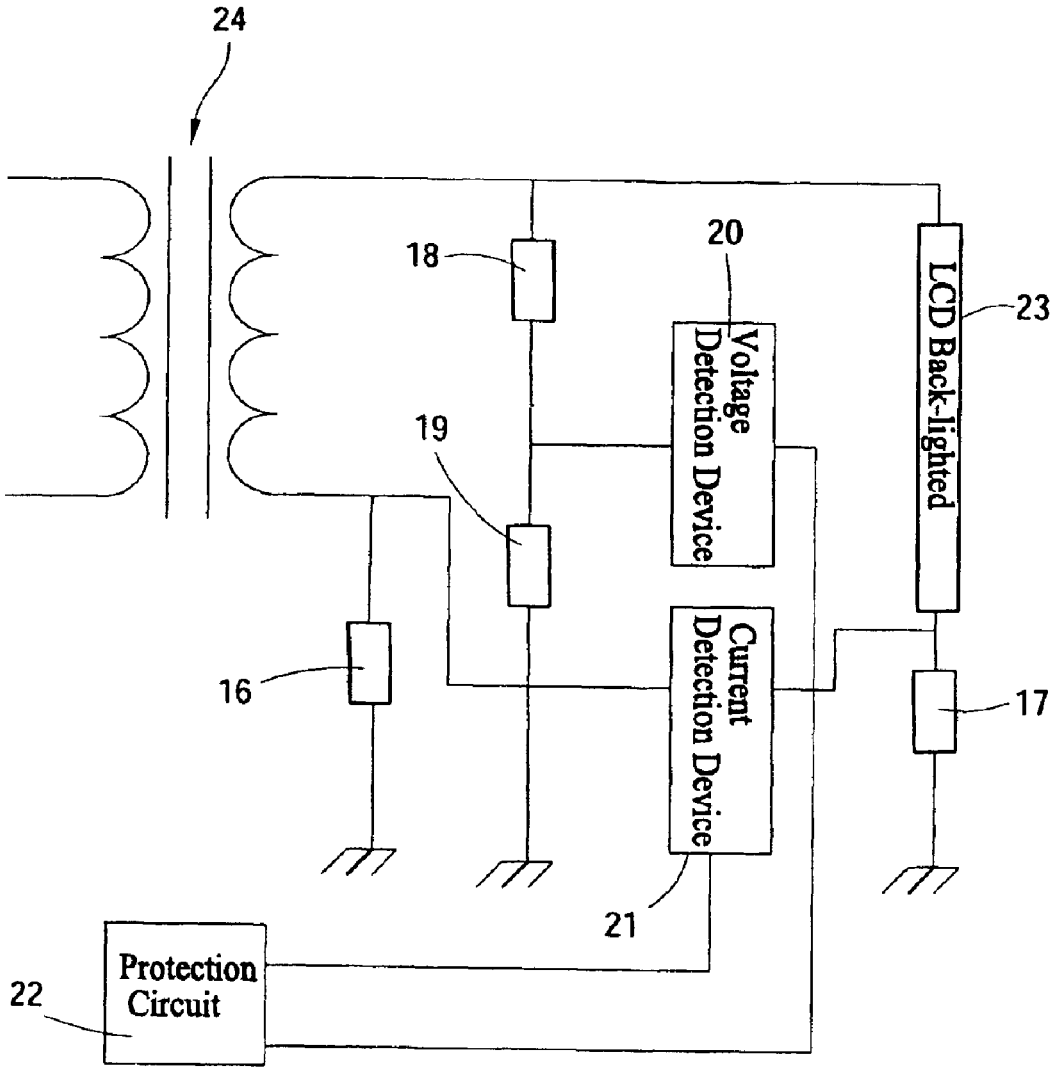
Fig.1 PRIOR ART
FIG. 1 shows a drawing of the traditional back-lighted drive circuitry protection device for the LCD.
Figure 2:
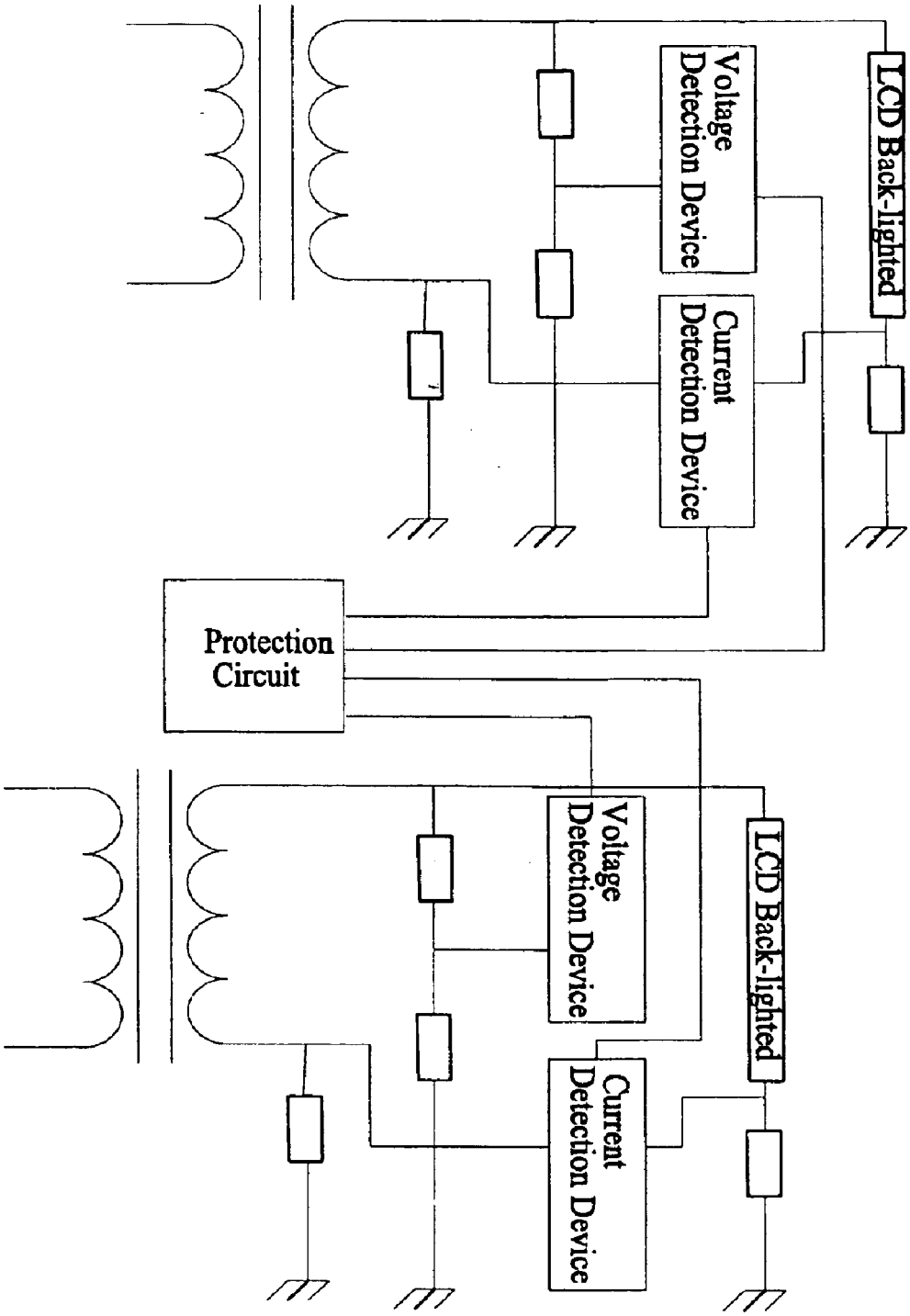
Fig.2 PRIOR ART
FIG. 2 shows another drawing of the traditional back-lighted drive circuitry protection device for the LCD.
Figure 4:
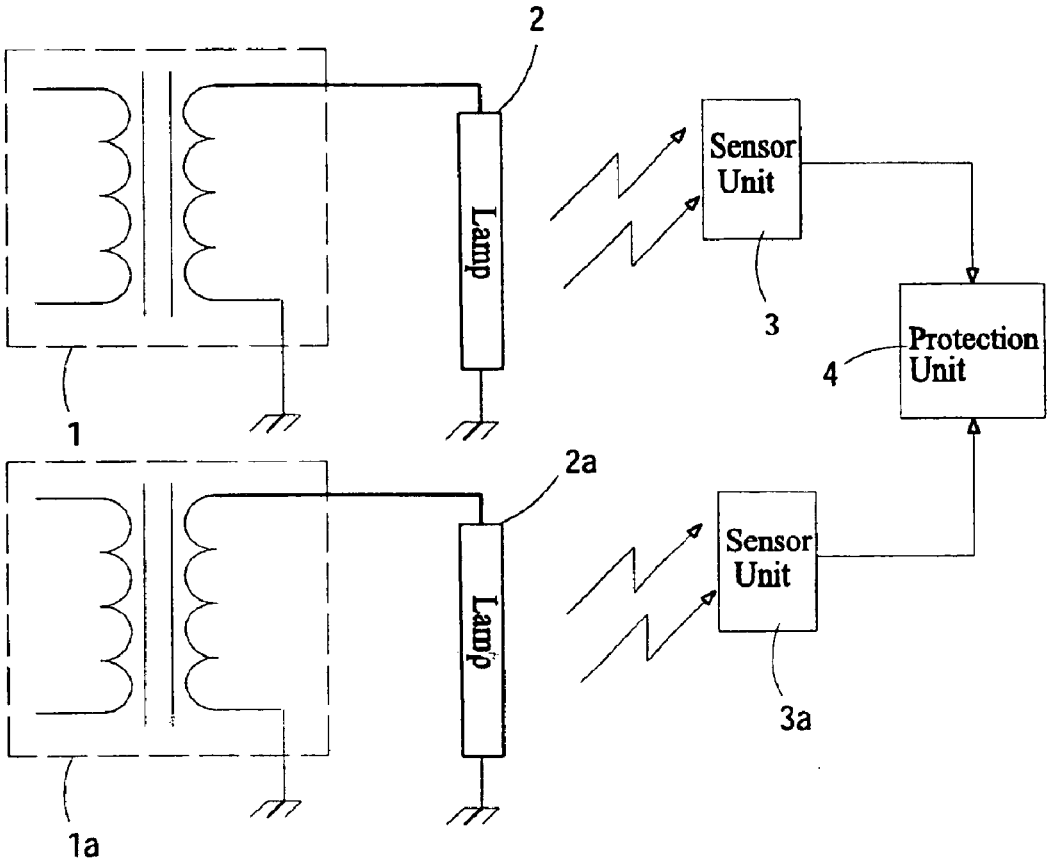
FIG. 4 shows a view of dual lamps for this invention.

Refer to FIG. 4 for the drawing of this invention for dual lamps. As the figure shows, the embodiment is the same as that indicated in FIG. 1. The only difference is an extra set of a driver circuit 1*a*, a lamp 2*a* and a sensor unit 3*a*, and two sensor units 3 and 3*a* are connected to a common protection unit 4 respectively. When either the sensor unit 3 or the 3*a* detects the lamp 2 or the 2*a* is not lit, that sensor unit 3 or 3*a* will give out a signal to activate the protection unit 4, which will prevent the driver circuit 1 or 1*a* from any output of high-voltage power so that the driver circuit 1 or 1*a* can be protected.

Figure 5:
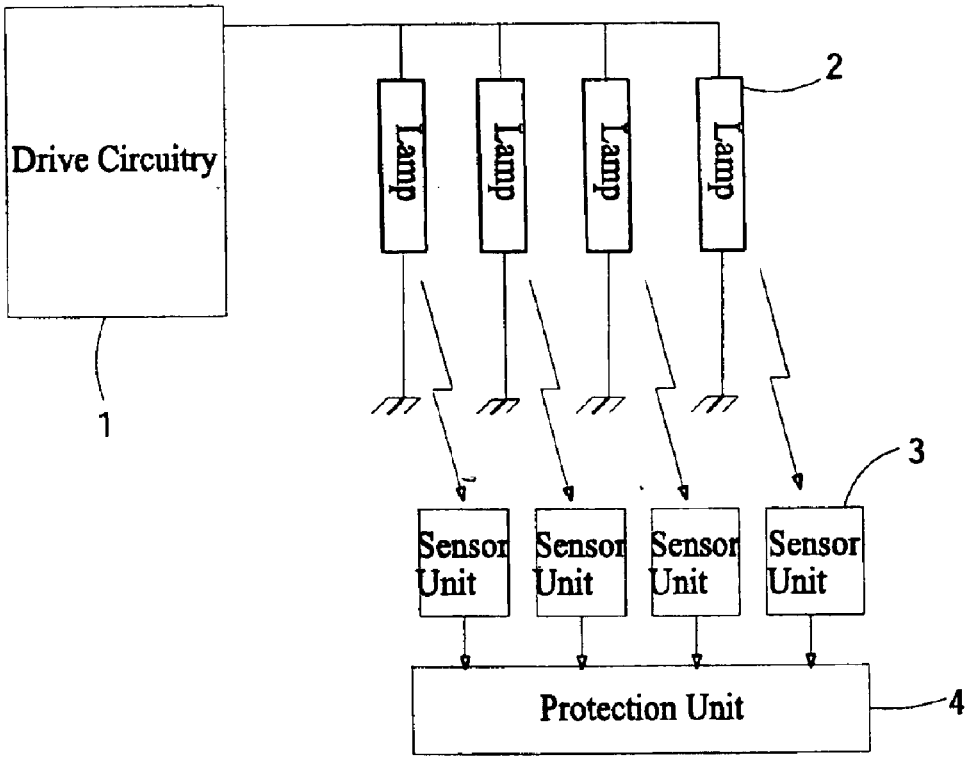
FIG. 5 shows a view of multiple lamps for this invention.

Refer to FIG. 5 for the drawing of this invention for multiple lamps. As the figure shows, the single driver circuit 1 is connected to multiple lamps 2, which are detected by several sensor units 3 in this embodiment. These sensor units 3 are jointly connected to the protection unit 4. When any of the multiple lamps 2 breaks down or has an open circuit, illumination will be stopped. Therefore, the light source detection unit 3 cannot sense any light, which indicates that the LCD back-lighted lamp 2 fails, the protection unit 4 is motivated and the driver circuit 1 is prevented from any output of high-voltage power supply.

Figure 6:
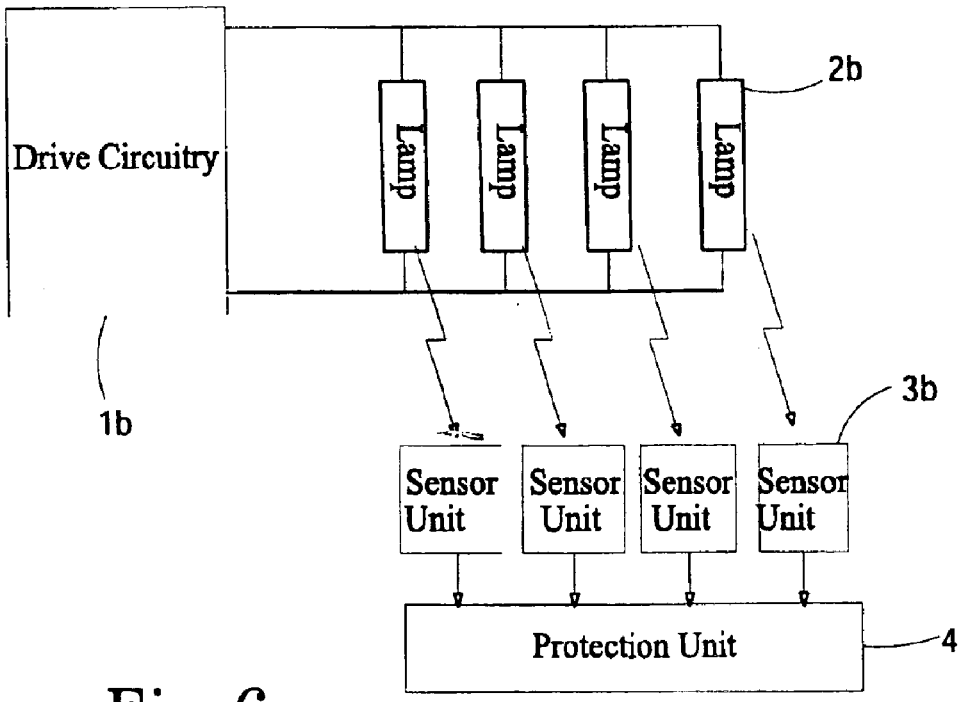
FIG. 6 shows a view of parallel connection of multiple lamps for this invention.
Figure 7:
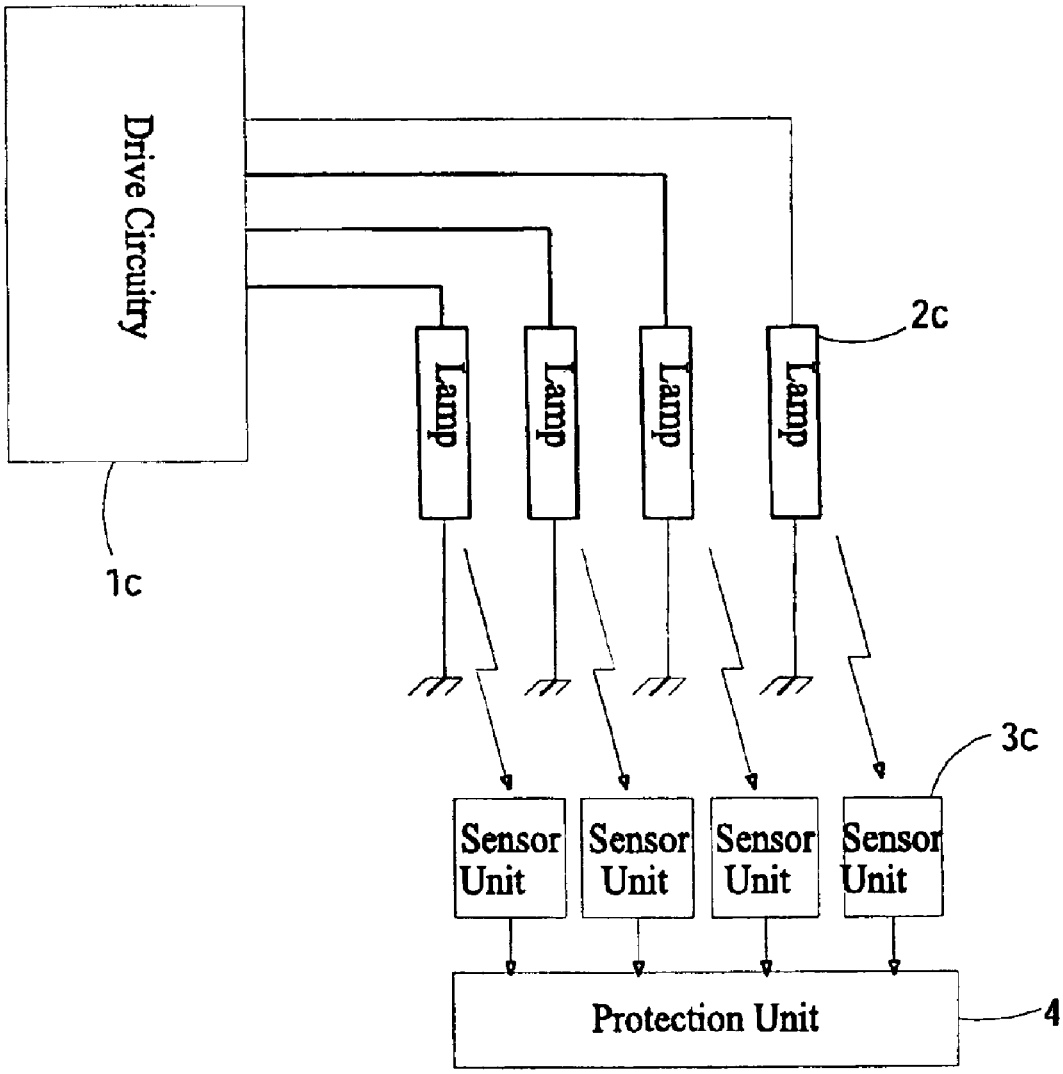
FIG. 7 shows a grounding view of multiple lamps for this invention.

Refer to FIGS. 6 and 7 for the drawings of parallel connection and grounding of multiple lamps for this invention. As the figures show, the LCD back-lighted lamp driver circuits in this embodiment are the well-known driver circuits 1*b* and 1*c*, which are used to supply power to the LCD back-lighted lamps 2*b* and 2*c*. As the LCD back-lighted lamps 2*b* and 2*c* are the commonly used Cold Cathode Fluorescent Lamp (CCFL) or the new External Electrode Fluorescent Lamp (EEFL), they can be applied to an illuminance device. Therefore, the status of the lamps 2*b* and 2*c* can be known through the sensor units 3*b* and 3*c* and protection against an open circuit of the lamps 2*b* and 2*c* will be judged and provided via the protection circuit 4.

Figure 8:
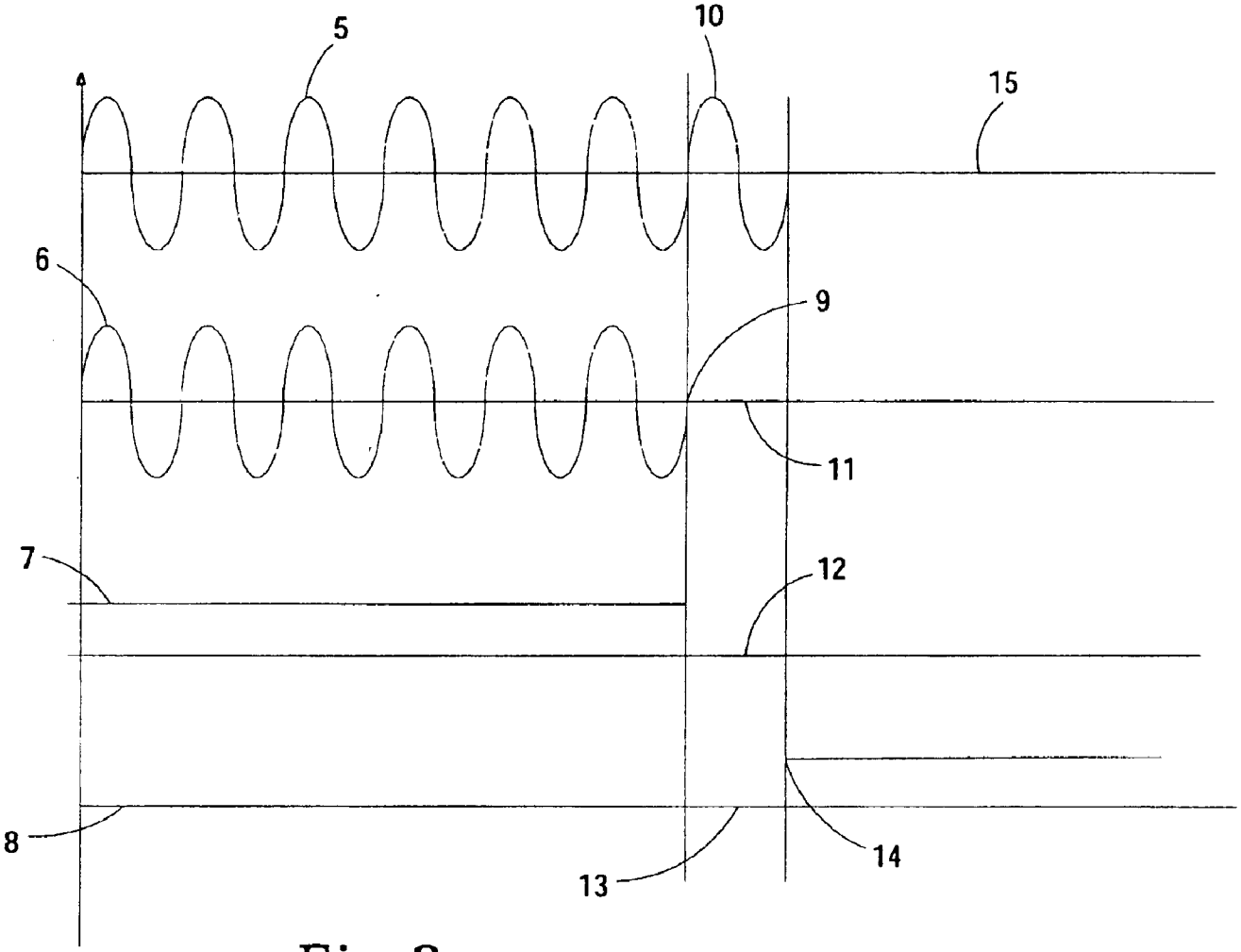
FIG. 8 shows a view of the sequences in FIG. 3.

Refer to FIGS. 3 and 8 for the drawings of single lamp for this invention and sequencing chart. As the figures show, the lamp 2 supplies high alternating voltage 5 and draws alternating current 6 under normal circumstances in the beginning. Thus, the sensor unit 3 detects radiation 7 of the lamp 2 and reveals a high level. As a result, the protection circuit 4 is not activated 8.

When the lamp 2 has an open circuit 9, high alternating voltage 10 supplies to the lamp 2 continuously; however, the lamp 2 with an open circuit can't draw the alternating current 11. Thus, the lamp 2 is not illuminated and the sensor unit 3 turns to a low level 12. The protection circuit is ready for judgment 13.

When the protection circuit 4 decides an open circuit 14 for the lamp 2, it will activate the driver circuit 1 to stop supplying high alternating voltage 15.

Figure 9:
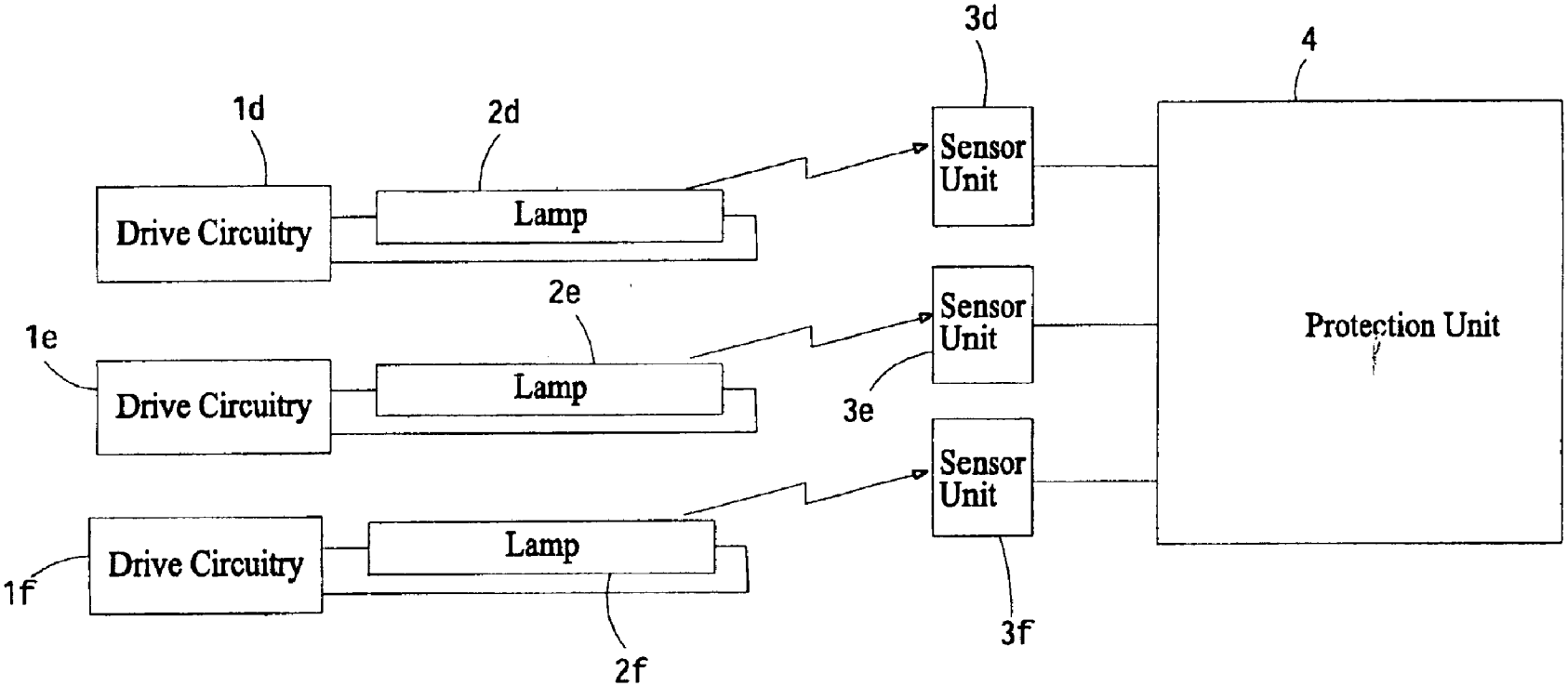
FIG. 9 shows a schematic view of the embodiment of the present invention.

Refer to FIG. 9 for another embodiment of this invention. As the drawing shows, every driver circuit 1*d*, 1*e* & 1*f* is used to drive every lamp 2*d*, 2*e* & 2*f* that are detected by sensor units 3*d*, 3*e* & 3*f*. The signals detected by the sensor units 3*d*, 3*e* & 3*f* are transmitted to the protection unit 4 for judgment respectively. Logic circuits are indicated as the following two truth tables (for 3 lamps):

TABLE 1

| Sensor Unit 3d | Sensor Unit 3e | Sensor Unit 3f | Protection Unit 4 |
|---|---|---|---|
| Fails | □ | □ | Activated |
| □ | Fails | □ | Activated |
| □ | □ | Fails | Activated |
| Normal | Normal | Normal | Inactivated |

TABLE 2

| Sensor Unit 3d | Sensor Unit 3e | Sensor Unit 3f | Protection Unit 4 |
|---|---|---|---|
| Fails | □ | □ | Turn off driver circuit 1d for lamp 2d. |
| □ | Fails | □ | Turn off driver circuit 1e for lamp 2e. |
| □ | □ | Fails | Turn off driver circuit 1f for lamp 2f. |
| Normal | Normal | Normal | Inactivated |

The integrated circuit system of this invention copes with the development of large-sized backlit LCD with the advantages as follows:

1. Use one or several light source detectors as the element of detecting the brightness of the lamp and implement protection measures.

2. When the current of the lamp is getting greater, illuminance becomes higher. Thus, brightness of the light source detector is equivalent to the current of the lamp. The operation status of the lamp can be known through the illumination detected by the light source detector.

3. This light source detection element can be applied as a protection countermeasure against an open circuit of the lamp.

4. This simple light source detector is characterized with the advantages of simplified circuit design.

5. This simple light source detector has the features of not consuming power and detecting equivalent current of the lamp.

6. For certain backlit drive circuitry protection wires that can't detect current but voltage, high-voltage elements are required for protection. However, status of the lamp can be known without detecting voltage by this simple light source detector.

7. A streamlined protection device against an open circuit for the lamp is provided.

What is claimed is:

1. A back-lighted control and protection device for LCD (Liquid Crystal Display) which comprises a light source and a drive circuitry generating a high-voltage supply to said light source for illuminating a backplate of the LCD, wherein said back-lighted control and protection device comprises:

a light source detection unit for detecting a light intensity of said light source, wherein said light source detection unit sends out a cut off signal when said light source detection unit detects said light intensity of said light source below a predetermined light level; and a protection circuit electrically communicating with said light source detection unit and arranged in such a manner that when said protection circuit receives said cut off signal from said light source detection unit, said protection circuit is arranged for simultaneously deactivating said drive circuitry to cut off said high-voltage supply to said light source.

2. The back-lighted control and protection device, as recited in claim 1, wherein said light source detection unit sends out said cut off signal to said protection circuit when said light source is malfunctioned that no light is generated therefrom.

3. The back-lighted control and protection device, as recited in claim 1, wherein said light source detection unit comprises a plurality of sensor units for communicating with lamps of said light source respectively, such that each of said sensor units is arranged for detecting said light intensity of said corresponding lamp of said light source.

4. The back-lighted control and protection device, as recited in claim 2, wherein said light source detection unit comprises a plurality of sensor units for communicating with lamps of said light source respectively, such that each of said sensor units is arranged for detecting said light intensity of said corresponding lamp of said light source.

5. The back-lighted control and protection device, as recited in claim 3, wherein said sensor units are electrically connected to said protection circuit such that said protection circuit receives said cut off signal from one of said sensor units for deactivating said drive circuitry when said respective lamp is malfunctioned.

6. The back-lighted control and protection device, as recited in claim 4, wherein said sensor units are electrically connected to said protection circuit such that said protection circuit receives said cut off signal from one of said sensor units for deactivating said drive circuitry when said respective lamp is malfunctioned.

7. A back-lighted assembly for LCD (Liquid Crystal Display) having a backplate, comprising:

a light source;

a drive circuitry generating a high-voltage supply to said light source for illuminating said backplate of said LCD; and a back-lighted control and protection device, which comprises:

a light source detection unit detecting a light intensity of said light source, wherein said light source detection unit sends out a cut off signal when said light source detection unit detects said light intensity of said light source below a predetermined light level; and a protection circuit electrically communicating with said light source detection unit and arranged in such a manner that when said protection circuit receives said cut off signal from said light source detection unit, said protection circuit simultaneously deactivates said drive circuitry to cut off said high-voltage supply to said light source.

8. The back-lighted assembly, as recited in claim 7, wherein said light source comprises a plurality of lamps for illuminating said backplate, wherein said protection circuit is electrically coupled to said lamps in series connection.

9. The back-lighted assembly, as recited in claim 7, wherein said light source comprises a plurality of lamps for illuminating said backplate, wherein said protection circuit is electrically coupled to said lamps in parallel connection.

10. The back-lighted assembly, as recited in claim 8, wherein said light source detection unit comprises a plurality of sensor units electrically connected to said protection circuit, wherein each of said sensor units detects said light intensity of said corresponding lamp of said light source such that said protection circuit receives said cut off signal from one of said sensor units to deactivate said drive circuitry when said respective lamp is malfunctioned.

11. The back-lighted assembly, as recited in claim 9, wherein said light source detection unit comprises a plurality of sensor units electrically connected to said protection circuit, wherein each of said sensor units detects said light intensity of said corresponding lamp of said light source such that said protection circuit receives said cut off signal from one of said sensor units to deactivate said drive circuitry when said respective lamp is malfunctioned.

12. The back-lighted assembly, as recited in claim 7, wherein said light source detection unit sends out said cut off signal to said protecfion circuit when said light source is malfunctioned that no light is generated therefrom.

13. The back-lighted assembly, as recited in claim 8, wherein said light source detection unit sends out said cut off signal to said protection circuit when said light source is malfunctioned that no light is generated therefrom.

14. The back-lighted assembly, as recited in claim 9, wherein said light source detection unit sends out said cut off signal to said protection circuit when said light source is malfunctioned that no light is generated therefrom.

15. The back-lighted assembly, as recited in claim 10, wherein said light source detection unit sends out said cut off signal to said protection circuit when said light source is malfunctioned that no light is generated therefrom.

16. The back-lighted assembly, as recited in claim 11, wherein said light source detection unit sends out said cut off signal to said protection circuit when said light source is malfunctioned that no light is generated therefrom.

* * * * *